United States Patent [19]

Nakano et al.

[11] Patent Number: 4,861,375

[45] Date of Patent: Aug. 29, 1989

[54] RUST PREVENTIVE COMPOSITION FOR STEEL REINFORCEMENTS

[75] Inventors: Sota Nakano, Tokyo; Shinsaku Tada, Hino, both of Japan

[73] Assignee: Misawa Home Kabushiki Kaisha, Tokyo, Japan

[21] Appl. No.: 726,424

[22] Filed: Apr. 24, 1985

[30] Foreign Application Priority Data

Jul. 30, 1984 [JP] Japan ..... 59-159959

[51] Int. Cl.[4] ..... C04B 24/10

[52] U.S. Cl. ..... 106/90; 106/92

[58] Field of Search ..... 106/90, 92, 315

[56] References Cited

U.S. PATENT DOCUMENTS

| | | | |
|---|---|---|---|
| 3,885,985 | 5/1975 | Serafin et al. | 106/315 |
| 4,060,425 | 11/1977 | Harada et al. | 106/315 |
| 4,088,804 | 5/1978 | Cornwell et al. | 428/220 |
| 4,092,109 | 5/1978 | Rosenberg et al. | 106/315 |
| 4,286,992 | 9/1981 | Galer et al. | 106/90 |

FOREIGN PATENT DOCUMENTS 2111041 6/1983 United Kingdom .

OTHER PUBLICATIONS

Chem. Abs., 89:48049n, "Hydration of a $4CaO.3Al_2O_3.SO_3$ Cement Paste in the Presence of Calcium Hydroxide, Calcium Sulfate Dihydrate and Some Organic Compounds", Collepardi et al., 1976.

Chem. Abs., 92:98119t, "Self Hardening Sand Mold", Kariyone et al., 1979.

*Primary Examiner*—William R. Dixon, Jr.

*Assistant Examiner*—Andrew Griffith

*Attorney, Agent, or Firm*—Emmanuel J. Lobato; Robert E. Burns

[57] ABSTRACT

Disclosed is a rust preventive composition for steel reinforcements for concrete, which comprises 100 parts by weight of Portland cement, 0.3 to 3 parts of a hydroxycarboxylic acid, 0.3 to 3 parts of a saccharide, 2 to 10 parts as a solid content of a polymer latex, 0 to 5 parts of an optional additive and 30 to 45 parts of water, all parts being by weight. In this composition, an excellent synergistic effect is attained by the combined use of the hydroxycarboxylic acid and saccharide. That is, hydration is almost completely suppressed in this composition under ordinary rust preventing treatment conditions, but hydration is effectively promoted under high-temperature high-pressure hydrothermal curing conditions. Gluconic acid and sorbitol are especially preferred as the hydroxycarboxylic acid and saccharide, respectively.

7 Claims, 1 Drawing Sheet

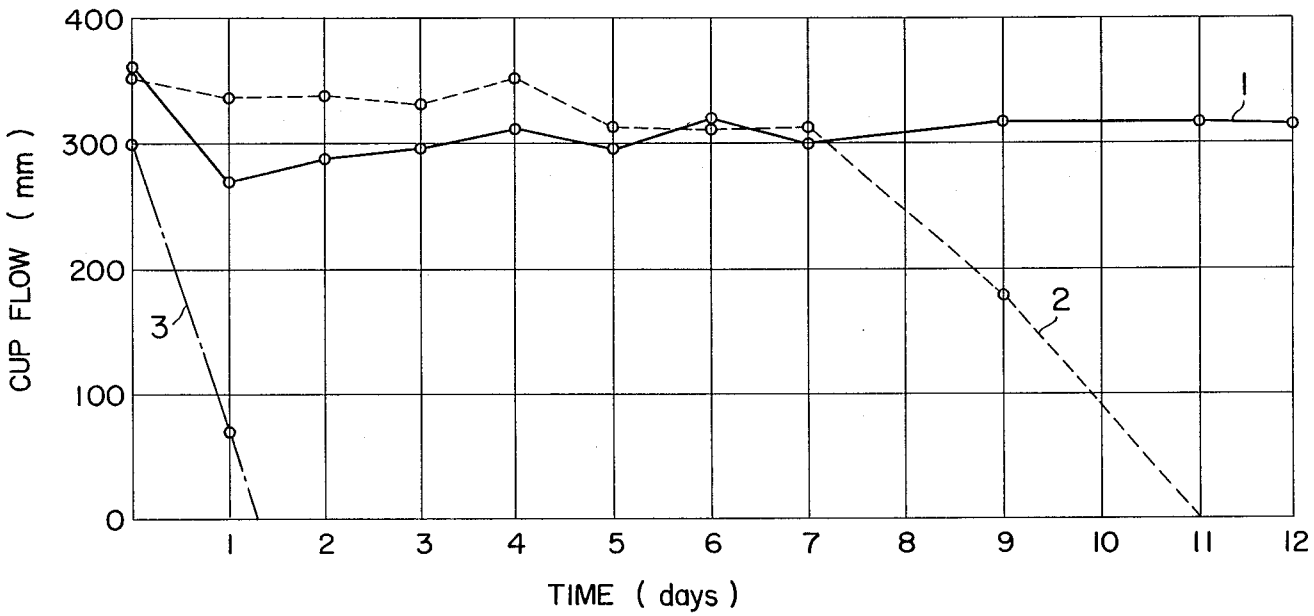
CUP FLOW ( mm )
400
300
200
100
0
TIME ( days )
1
2
3
4
5
6
7
8
9
10
11
12
1
2
3

RUST PREVENTIVE COMPOSITION FOR STEEL REINFORCEMENTS

BACKGROUND OF THE INVENTION

1. Field of the Art

The present invention relates to a cement-based rust preventive composition for steel reinforcements for concrete (inclusive of steel frames). More particularly, the present invention relates to a cement-based rust preventive composition in which hydraulic setting is retarded.

2. Description of the Prior Art

From the viewpoint of reduction of the weight of concrete buildings and other structures and from the energy-saving viewpoint, interest in cellular concrete has been increasing, and so-called prefabrication has been promoted, whereby cellular concrete panels have come to be used in large quantities.

As a typical instance of cellular concrete, so-called ALC, viz. autoclaved light weight concrete, can be mentioned. This material is light concrete (LC) composed mainly of crystal calcium silicate hydrate of the tobermorite species, which is formed by hydrothermally curing a foamed and set product at a high temperature under a high pressure in an autoclave (A). It has a large commercial value as a stable construction material.

ALC now manufactured on an industrial scale is divided into a post-foam type and a pre-foam type according to the method for forming a cellular structure. In each case, when a hydraulic cement composition slurry is cast, a steel reinforcement having an appropriate shape is ordinarily arranged so as to reinforce a formed concrete product.

High-temperature, high-pressure, hydrothermal curing conditions to be applied to ALC cause extreme corrosion and rusting in steel reinforcements. Furthermore, as concrete per se is neutralized by carbon dioxide in the air and loses its alkalinity, rusting is similarly caused in steel reinforcements. Accordingly, it is necessary to subject steel reinforcements to a rust-resisting treatment.

As an example of the rust preventives used for giving resistance to rust to steel reinforcements, an agent comprising cement as a main component can be mentioned. The cement-based rust preventive comprises an aqueous dispersion of cement and auxiliary additives to be incorporated according to need. The rust-preventing treatment is ordinarily accomplished by dipping a steel reinforcement in a bath of the rust preventive comprising this aqueous dispersion to cover the surface of the steel reinforcement with a rust preventive component such as cement.

When this rust preventing treatment is practically carried out, a cement dispersion is prepared in a considerable amount necessary for dipping a structure formed by assembling steel reinforcements in this cement dispersion, and the so-prepared cement dispersion is stored in a rust preventive tank. Since cement can set hydraulically, utilization of a cement dispersion in the above described manner is very disadvantageous. More specifically, if the cement dispersion left after the rust preventing treatment is left standing, setting takes place so that the cement dispersion loses workability, resulting in great loss of the cement dispersion. Even if setting does not take place, the viscosity will be increased by a hydration reaction, and the amount of the cement adhering to the steel reinforcement cannot be controlled. This problem can be temporarily solved by the use of a setting retardant, but since the setting retarding effect of the known setting retardant does not last for a long time as far as I am aware, the problem remains still unsolved.

If a cement-based rust preventive which is controlled so that almost no hydration reaction occurs under ordinary rust preventing treatment conditions but the hydration reaction progresses under high-temperature high-pressure hydrothermal aging conditions could be developed, it would be a great contribution to the art.

SUMMARY OF THE INVENTION

It is a primary object of the present invention to solve the above problems accompanying the conventional techniques. According to the present invention, this object is attained by the use of a specific setting retardant.

More specifically, in accordance with the present invention, there is provided a rust preventive composition for steel reinforcements for concrete, which comprises 100 parts by weight of Portland cement, 0.3 to 3 parts by weight of a hydroxycarboxylic acid, 0.3 to 3 parts by weight of a saccharide, 2 to 10 parts by weight as a solid content of a polymer latex, 0 to 5 parts by weight of an optional additive, and 30 to 45 parts by weight of water.

BRIEF DESCRIPTION OF THE DRAWING

In the drawing the single FIGURE is a graph indicating the change of the cup flow value of a rust preventive composition of the invention with time.

DETAILED DESCRIPTION OF THE PREFERRED EMBODIMENTS

In the cement-based rust preventive composition of the present invention, setting is effectively retarded so that even if a steel reinforcement treated with this composition is dried after the treatment, setting takes place to some extent but hydration is insufficient, but under high-temperature, high-pressure hydrothermal aging conditions in an autoclave, hydration is promoted to form $Ca(OH)_2$ and a rust preventing effect is manifested. Moreover, because of setting caused to some extent by drying conducted after the rust preventing treatment, the formed coat or film of the rust preventive adheres tightly to the steel reinforcement.

Moreover, in the once-prepared dispersion of the rust preventive according to the present invention, change of viscosity can be substantially inhibited for about 2 to about 10 days. Accordingly, if there is adopted a method in which about $\frac{1}{3}$ of the prepared dispersion is used for 1 day and a fresh dispersion is supplied to the residual dispersion everyday, the bath of the rust preventive can be used for an indefinite time and no loss is caused by setting.

This excellent setting-retarding effect of the rust preventive composition of the present invention cannot be expected at all from the effect attained by the use of a single known setting retardant agent such as a hydroxycarboxylic acid or a saccharide, and synergism is thus found between these two components according to the present invention, which will readily be understood from the examples given hereinafter.

RUST PREVENTIVE COMPOSITION

The rust preventive composition of the present invention will now be described in detail.

The rust preventive composition for steel reinforcements for concrete according to the present invention is a cement-based composition and comprises components described in detail hereinafter. By the term "steel reinforcement" used in the present invention is meant a reinforcing structure made of a ferrous material such as steel to be used in the interior of concrete, and the steel reinforcement includes a steel frame as well.

Portland Cement

The main component of the rust preventive composition of the present invention is Portland cement. It is known that Portland cement is used as a rust preventive, and any of known cements included in the category of "Portland cement" can be used in the present invention.

A cement ordinarily available as regular Portland cement may be used as the Portland cement in the present invention, but Portland cement having a $C_3S$ content of 50% by weight or lower and a $C_3A$ content 8% by weight or lower (C, S and A represent CaO, $SiO_2$ and $Al_2O_3$, respectively) such as medium heat Portland cement, is especially preferred.

Hydroxycarboxylic Acid and Saccharide

It is known that these components can be used as a setting retardant. In the present invention, appropriate components are selected from known compounds and they are used according to the present invention in combination for attaining the synergistic effect.

Examples of hydroxycarboxylic acids suitable for use in the present invention are gluconic acid, citric acid and tartaric acid, gluconic acid being especially preferred.

Any of the monosaccharides and disaccharides can be used as the saccharide in the present invention, as long as it is soluble in the aqueous composition of the present invention. Sorbitol is especially preferred.

Polymer Latex

It is known that a polymer latex is incorporated into a cement composition slurry, and also in the present invention, various polymer latices compatible with a cement composition slurry can be used.

As the polymer latex used in the present invention, for example, a styrene-butadiene copolymer (SBR) latex, an acrylonitrile-butadiene copolymer (NBR) latex and a vinyl acetate polymer latex can be used. An SBR latex is especially preferred.

Optional Additives

The rust preventive composition of the present invention can further comprise a dispersant, an antioxidant for the polymer, a water repellant and a thickening agent. These additives are not particuarly critical, but they should be compatible or miscible with the above-mentioned indispensable components.

Water/Formation of Rust Preventive Composition

The last component is water, and the rust preventive composition of the present invention is an aqueous dispersion of the above-mentioned components.

The rust preventive composition of the present invention can be prepared by mixing the above-mentioned components stepwise or at one time. The mixing ratios of the respective components are as described hereinbefore.

The utilization of the above mentioned rust-resisting composition of the present invention will now be described.

USE OF THE RUST PREVENTIVE

Rust Preventing Treatment

The rust preventing treatment can be carried out according to any mode by which the rust preventive composition of the present invention is applied to a steel reinforcement to form a rust preventing coat on the surface of the steel reinforcement. According to a typical mode of practice, a steel reinforcement is dipped in a bath of the rust preventive composition and is then dipped again after drying, if necessary.

Production of Reinforced ALC

It is known that ALC is prepared by arranging a steel reinforcement, which has been subjected to the rust preventing treatment as described above, in concrete. This method is described in bibliographical references, for example, "Fine Ceramics", Volume 4, Pages 56-66 (1983) and "Concrete Engineering", Volume 18, No. 12, Pages 1-10 (1980), both in the Japanese language.

EXPERIMENTATION

The present invention will now be described in detail with reference to the following examples that by no means limit the scope of the invention.

EXAMPLE 1

A rust preventive composition comprising the following components was prepared by homogeneously dispersing Portland cement in an aqueous solution of gluconic acid and sorbitol and then adding thereto an SBR latex to the dispersion:

| | |
|---|---|
| Portland cement | 100 parts by weight |
| Gluconic acid | 1 part by weight |
| Sorbitol | 1 part by weight |
| SBR latex | 5 parts by weight (as solids) |
| Water | 38 parts by weight |

The setting-retarding property of this composition was examined. More specifically, the composition was allowed to stand still at 20° C. and was then stirred by a chemistirrer, and the change of the cup flow value with time was determined. The cup flow value indicates the diameter of the mass of the slurry flown on a stainless-steel flat plate from a cylindrical bottomless cup having an inner volume of 210 ml placed on the stainless-steel flat plate and filled with the slurry when the cup is raised and separated from the plate.

The obtained results are shown in Curve 1 of the FIGURE of the accompanying drawing. For comparison, the above experiment was carried out by using a composition of only gluconic acid and sorbitol (the amounts were the same as indicated above), and the obtained results (changes of the cup flow values with time) are shown in Curves 2 and 3, respectively, of the FIGURE.

From the results shown in the FIGURE, it will readily be understood that the synergism attained by the use of gluconic acid and sorbitol in combination according to the present invention is remarkable.

EXAMPLE 2

A polished steel rod having a diameter of 9 mm and a length of 14 cm, which had been amply degreased, was dipped in the rust preventive composition prepared in Example 1 to form a coat having a thickness when dried of about 0.8 mm on the surface of the steel rod, and the coat was dried. The rod was placed in the central portion of a steel mold having a size of 40 mm×40 mm ×160 mm, and a foamed slurry having a $CaO/SiO_2$ weight ratio of 4/6 and an apparent specific gravity of 0.8 was cast in the remainder portion of the mold and was thereby solidified. The molded article was hydrothermally cured in an autoclave at 180° C. for 10 hours to form a test piece. Ten test pieces so prepared were sprayed with a saline solution for 1,000 hours according to the salt spray test method of JIS Z-2371. The surface of the steel rod after removal of the surrounding cellular concrete portion and the rust preventive applied was examined. It was found that no rusting whatsoever had been caused.

What is claimed is:

1. A rust preventive composition for steel reinforcements for concrete, which consists essentially of 100 parts by weight of Portland cement, 0.3 to 3 parts by weight of a gluconic acid, 0.3 to 3 parts by weight of sorbitol, 2 to 10 parts by weight as solids of a styrene-butadine copolymer latex and 30 to 45 parts by weight of water.

2. A rust preventive composition as set forth in claim 1, wherein the Portland cement has a $C_3S$ content of 50% by weight or lower and $C_3A$ content of 8% by weight or lower.

3. A rust preventive composition as set forth in claim 1, in which the composition is settable in a predetermined period of time but remains substantially unset for at least to days.

4. A method of forming a coat of a rust preventive composition on a steel reinforcement for concrete, which comprises providing a bath of an aqueous rust preventive composition which consists essentially of 100 parts by weight of Portland cement, 0.3 to 3 parts by weight of a gluconic acid, 0.3 to 3 parts by weight of a sorbitol, 2 to 10 parts by weight as solids of a styrene-butadine copolymer latex and 30 to 45 parts by weight of water, dipping a steel reinforcement for concrete in the bath at least one time, and drying after each dipping, whereby to form a dried coat of the rust preventive composition on the steel reinforcement, placing the steel reinforcement thus obtained in a mass of a cement slurry in a mold of a predetermined shape, partially setting the cement slurry so that the mass will be self-sustaining without the mold, unmolding the partially set mass of the cement slurry and subjecting said partially-set mass to hydrothermal curing in an autoclave at an elevated temperature and under super atmospheric pressure, thereby finally to set the partially-set mass of cement slurry.

5. The method of forming a rust preventive composition as set forth in claim 4, wherein the Portland cement has a $C_3S$ content of 50% by weight or lower and a $C_3A$ content of 8% by weight or lower.

6. The method of forming a coat of a rust preventive composition on a steel reinforcement as claimed in claim 4, in which the cement slurry is suitable to form an autoclaved light-weight concrete.

7. The method of forming a coat of a rust preventive composition on a steel reinforcement as claimed in claim 4, in which the bath of the aqueous rust preventive composition is replenished for further use after at least approximately one-third of it has been consumed in a day.

* * * * *